United States Patent [19]

Hemsath et al.

[11] 4,142,712

[45] Mar. 6, 1979

[54] METHOD AND APPARATUS FOR EFFECTING UNIFORM HEAT TRANSFER IN AN INDUSTRIAL FURNACE

[75] Inventors: Klaus H. Hemsath, Sylvania, Ohio; Frank J. Vereecke, Palmyra, Mich.

[73] Assignee: Midland-Ross Corporation, Cleveland, Ohio

[21] Appl. No.: 811,747

[22] Filed: Jun. 30, 1977

[51] Int. Cl.[2] ..... F27B 11/00

[52] U.S. Cl. ..... 266/44; 266/264; 432/179; 432/206; 432/254.1

[58] Field of Search ..... 432/144, 146, 149, 152, 432/179, 190, 199, 206, 254.1; 266/255, 256, 262, 263, 264, 44

[56] References Cited

U.S. PATENT DOCUMENTS

| | | | |
|---|---|---|---|
| 2,011,119 | 8/1935 | Schack | 432/179 |
| 2,220,797 | 11/1940 | Bates et al. | 432/206 |
| 2,277,595 | 3/1942 | Levy et al. | 432/72 |
| 3,405,923 | 10/1968 | Nesbitt et al. | 432/206 |
| 3,782,893 | 1/1974 | Blackman | 432/206 |

*Primary Examiner*—Louis J. Casaregola

*Attorney, Agent, or Firm*—Frank J. Nawalanic

[57] ABSTRACT

A heat treating furnace is provided with high momentum burners for uniformly heating each work item therein primarily by convective heating. A plurality of work items are spaced in a row on a furnace base and enclosed by an outer cover sealed to the base to define an enclosure therein. High momentum burners are orientated in a predetermined manner in the outer cover to fire jet streams of hot gases into the enclosure. The jet streams rapidly entrain the furnace gases to promote a gas stream of uniform temperature which swirls rapidly about each work item effecting uniform heating of each work item primarily by convection. The furnace is further provided with an efficient internal recuperator arrangement which also functions as the flue for the furnace.

9 Claims, 11 Drawing Figures

METHOD AND APPARATUS FOR EFFECTING UNIFORM HEAT TRANSFER IN AN INDUSTRIAL FURNACE

This invention relates generally to method and apparatus for heat treating operations and, more particularly, to method and apparatus for transferring heat by convection in a uniform manner to or from multiple work items placed in a sealed enclosure.

The invention is particularly applicable to multistand batch coil annealing furnaces and will be described with particular reference thereto. However, it will be appreciated by those skilled in the art that the invention has broader applications and may be applied, preferably, to any batch type and, in certain instances, continuous heat treating operations where a plurality of work items are to be placed in heat transfer relationship with a cooling or heating medium.

Annealing of metal strip and the like is generally accomplished by winding the strip into coils, placing several coils on top of one another into a stack, enclosing the coils in a sealed manner by means of an inner cover and enclosing the inner cover by an outer furnace cover. In multistand annealers, the outer cover encloses two or more inner covers. The outer cover carries some form of heat means for heating the inner covers which in turn transfer the heat to the coils while a proper annealing atmosphere is maintained in the inner covers. It is believed that any attempt at eliminating the inner covers would not prove commercially successful because, among other reasons, the atmosphere in such arrangements could not be properly controlled.

Conventional, multistand annealing furnaces employ either radiant tubes or direct fired burners to provide the heat input for heating the inner covers. In radiant tube arrangements, a maze of alloyed tubing is strategically positioned about the inner covers. The tubes are heated, either electrically or by burners firing their products of combustion therethrough, and the heat from the tubes is radiated to the inner covers. Such arrangements are obviously cumbersome and expensive. The prior art has recognized these problems and more recently has employed direct-fired, low forward-velocity burners in place of the radiant tubes. These burners directly fire their products of combustion into the refractory-lined chamber of the outer furnace cover and the furnace cover radiates the heat from its walls to the inner covers. The direct-fired burner arrangement is less expensive than its radiant tube counterpart but a large number of burners are required and there are inherent limitations affecting the placement of burners with respect to the outer furnace cover to effect uniform heating. With both conventional arrangements, some thought has been given to the use of fans to provide uniform circulation of heat to the inner covers. However, such arrangements would materially increase the cost of the furnace and the cover life would not be materially extended.

A number of different heating arrangements have been proposed for single stand annealing furnaces. Since the outer furnace cover completely surrounds the inner cover in the single stand furnace, an arrangement is presented which permits the heating of the inner cover to be accurately controlled about its circumference and its length. Some single stand annealing furnaces have employed multiple burners spaced in two or three rows about the inner cover firing their products of combustion in a manner which tangentially swirls about the cover. The inventors also believe that an arrangement has been employed which uses only a single row of burners. However, these burners are not of the high momentum type and their application, as noted, is limited to single stand furnaces where their velocity patterns can be controlled.

The use of high momentum burners in the industrial heat treat art is known. In U.S. Pat. No. 3,198,855, high velocity burners are used in soaking pits for purposes of distributing the gases within the pit to promote more uniform temperature distribution while avoiding a short circuiting of the burner gases through the furnace flue. There is no attempt in the '855 patent to individually heat each ingot within the pit and it is believed that certain ingots within the pit will be heated to varying degrees at varying rates depending on their position in the pit. In U.S. Pat. No. 3,819,323, high velocity jets are used in a minimum scale reheat furnace. The jets function to establish boundary zones within the furnace while utilizing their entrainment characteristics to insure burndown of gases within the zones. While the work is heated in a controlled atmosphere by the jets in the '323 patent, there is no attempt to individually heat each work item in a uniform manner by means of the jets.

It is thus an object of the present invention to provide a method and apparatus for heating (or cooling) a plurality of work items by the use of high momentum jet streams of gases arranged in a manner which uniformly heats (or cools) each item in the furnace.

This object along with other features of the invention is achieved in a heat transfer arrangement where a plurality (two or more) of work items are placed on a base. An outer furnace cover sealed to the base defines a heat transfer chamber enclosure containing the work items. Jet pump means is then provided to effect substantially uniform heat transfer with all surfaces of each work item. The jet pump means includes a plurality of high momentum or high velocity jet nozzles in an ordered array extending through the outer cover to inject gases (hot or cold) at high speed into the enclosure. The velocity of each jet is matched with the distance of each jet from the work item to insure that the furnace atmosphere within the enclosure has been substantially entrained within the jet prior to impinging or wiping any given work item. As a result of this entrainment, the temperature of the jetted gases approaches that of the furnace atmosphere while the velocity of the jetted gas decays. These characteristics of the jet coupled with the placement of the jets relative the work items result in uniform heat transfer with each and all work items.

More specifically, the outer furnace cover has a pair of generally parallel sidewalls, a pair of end walls and a roof. A plurality of "n" work items are arranged in a row on the furnace base along an axis generally parallel to a sidewall. Each work item is spaced laterally apart from an adjacent item at a minimum laterally spaced distance. Also the end items in the row are laterally spaced, at least at this minimum laterally spaced distance, from an associated end wall. The lateral spaces between the work items and the end work items and end walls thus total "n + 1" spaces and are consecutively numbered from either end wall. The jet nozzles are placed in at least one of the outer furnace cover sidewalls and each nozzle is orientated to issue its gas jet stream along a jet stream axis generally perpendicular to the row axis and approximately bisecting an associated lateral space. The jet nozzles thus positioned in one of the sidewalls are orientated to fire in odd-numbered spaces or alternatively even-numbered spaces while any jet nozzles positioned in the opposite sidewall are orientated to fire in even-numbered spaces or, alternatively, odd-numbered spaces, respectively. Such an arrangement produces a swirling stream of gases which travels about each work item with the direction of rotation of the gases about any given work item being opposite to the swirl established about any work item immediately adjacent to the given work item. Because the velocity of the jet stream rapidly diminishes (thereby avoiding furnace refractory breakdown) and the temperature of the jet stream is rapidly homogenized with the furnace atmosphere, as noted above, the circulation of the gases about each work item remains somewhat constant in temperature and velocity with the result that each work item is uniformly heated in both circumferential and vertical directions. Also the stream is moving about all the work items, all the work items are being uniformly heated at the same rate.

When the invention is utilized as a multistand batch coil annealing furnace, the work items comprise a plurality of metal coils placed on top of one another to define a stack and there is a plurality of "n" stacks. An inner cylindrical cover is disposed over each stack with each inner cover sealingly secured to the furnace base to define a heat treating chamber for each stack of coils contained therein. The jet nozzles comprise high momentum or high velocity burners extending through the furnace cover which operate in the manner described to heat the inner covers. It is a specific feature of the invention that existing radiant tube or direct-fired batch coil annealing furnaces are of sufficient dimension to be connected to the heat transfer arrangement of the subject invention with minimal expense.

In accordance with yet another feature of the invention, an internal heat recuperative system is provided for use in the arrangement described. The recuperative system includes a radiation shield extending along the interior of the side-wall of the furnace cover from the furnace roof to a predetermined distance from the burner axis of one of the burners. The shield and the furnace cover sidewall thus form a flue opening for the furnace. Within the flue opening a plurality of air tubes are in fluid communication at their upper ends with a cold air supply header and in fluid communication at their lower ends with a hot air collector. The hot air collector in turn communicates with tubing which extends through the sidewall to the burner to supply preheated air thereto. The radiation shield has a low profile which does not impede the gas flow pattern established by the burners and permits the recuperative system to be applied to existing radiant tube or direct-fired annealing furnaces which are converted to the heat transfer arrangement disclosed. The position of the flue opening being spaced downwardly in the furnace and immediately above the burner avoids short circuiting of jet gases while drawing off furnace atmosphere which is cooler at the lower part of the furnace than that which exists at the upper part of the furnace due to the buoyancy of the gases. The short distance that the tubing is exposed to ambient atmosphere after it passes through the furnace sidewall results in smaller temperature drops of the preheated air compared to external type recuperative systems.

It is thus another object of the subject invention to provide a new multistand batch coil annealing furnace which can be incorporated in conventional furnaces in operation.

It is yet another object of the invention to provide, in a multistand batch coil annealing furnace, an arrangement for heating the work with a minimum number of burners.

It is yet another object of the subject invention to provide, in conjunction with high convective, heat transfer apparatus, an internal, heat recuperative system which is efficient in operation and economical in construction.

Still another object of the subject invention is to provide in a heat treating furnace, freely expanding circular jets issuing high velocity gases which rapidly entrain the jetted gases within the furnace atmosphere to provide substantially uniform temperature flow about the work.

Yet another object of the subject invention is to provide, in a heat treating furnace, an ordered array of work items and jet nozzles which insure movement of gases about each work item for substantially uniform heat transfer to each work item.

Still another object of the subject invention is to provide a heat transfer arrangement suitable for use in batch-type, industrial heating furnaces.

Yet another object of the subject invention is to provide a heat treating furnace which is economical in construction and operation.

The invention may take physical form in certain parts and arrangement of parts, embodiments of which will be described in detail herein and illustrated in the accompanying drawings which form a part hereof and wherein.

Figure 1:
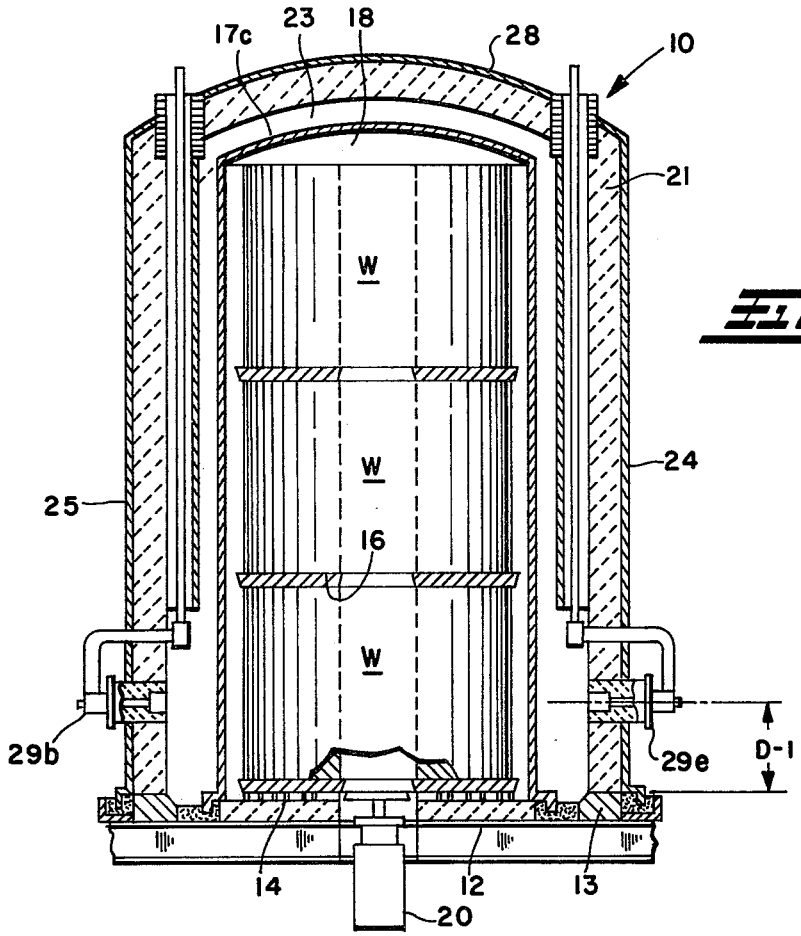
FIG. 1 is a cross-sectional, elevational view taken along line 1—1 of FIG. 2 of a heat treating furnace, of otherwise conventional design, which incorporates the present invention.

Referring now to the drawings wherein the showings are for the purpose of illustrating embodiments of the invention only and not for the purpose of limiting same, FIG. 1 illustrates a typical, multistand batch coil annealing furnace 10 which includes a plurality of inner bases 12 (only one being shown) circumscribed by an outer furnace base 13. Metal strip formed into coils and designated as "W" (work) in FIG. 1 is supported on each inner base 12 by a base plate 14 in a conventional manner, namely, the coils "W" are stacked one on top of the other while separated one from the other by means of conventional spacers 16. Over each stack of coils, "W", an inner cylindrical or bell-shaped cover 17 is disposed in sealing engagement with its respective inner base 12 in a conventional manner to define a heat treating chamber 18 encompassing each stack of work "W". A known fan and motor arrangement 20 extending through inner base 12 is provided for circulating an annealing gas atmosphere within heat treating chamber 18 in a uniform known manner whereby the work is annealed.

Outer furnace base 13 extends about the plurality of inner bases 12 and an outer furnace cover 21 is sealingly secured to outer furnace base 13 in a conventional manner to define a heat transfer enclosure 23 which contains a plurality of inner covers 17.

Figure 2:
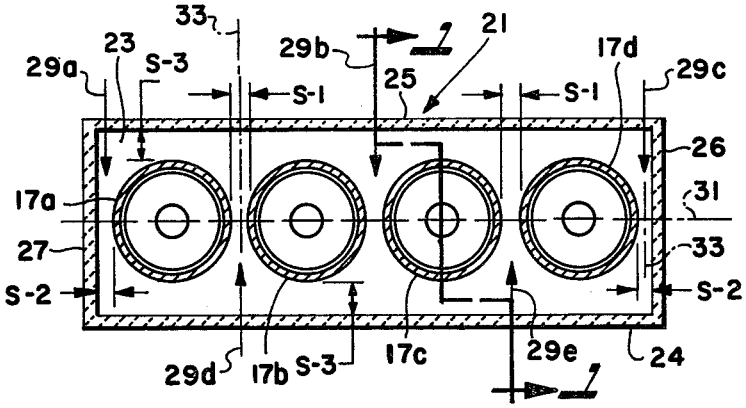
FIG. 2 is a schematic, plan sectional view of the furnace of FIG. 1.
Figure 2A:
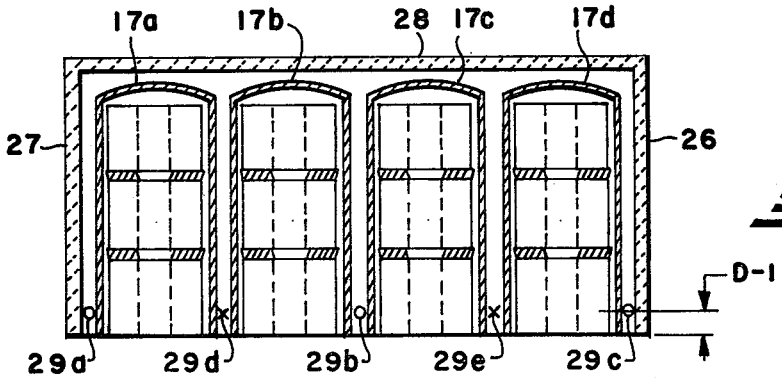
FIG. 2A is a schematic, vertical sectional view of the furnace of FIG. 2.

As best shown in FIG. 2, the plurality of inner covers 17 number four and the inner covers are designated 17*a*, 17*b*, 17*c* and 17*d*. Outer cover 21 is generally rectangular in shape and comprises a forward facing laterally extending sidewall 24, a rearward facing laterally extending sidewall 25 generally parallel to sidewall 24, a right side transversely extending end wall 26, a left side transversely extending end wall 27 and a roof 28 (FIG. 1). As used herein, reference to forward, rearward, right and left are relative terms and refer, respectively, to the front, rear, right and left side of the drawings as viewed by the reader. In the furnace shown in FIG. 2, arrows represent jet nozzles or high momentum burners 29 and there are three burners identified as 29*a*, 29*b*, 29*c* in the rearward laterally extending sidewall 25 and two burners identified as 29*d*, 29*e* in the forward laterally extending sidewall 24. As shown in FIG. 1, the burners extend through sidewalls 24, 25 to fire into heat transfer enclosure 23. The orientation of burners 29*a–e* is also illustrated in FIG. 2A where a burner represented by an "x" indicates that the burner is firing into heat transfer enclosure 23 in a forward to rearward direction (or into the plane of the drawing) while a burner indicated by an "o" indicates that the burner is firing into heat transfer enclosure 23 in a rearward to forward direction (or out of the plane of the drawing). FIG. 2A also shows that burners 29*a–e* are elevated upward a distance D-1 from outer furnace base 13.

In the furnace arrangement shown in FIGS. 1, 2 and 2A, inner covers 17*a–d* are centered on a laterally extending row axis 31 within heat transfer enclosure 23 which is generally parallel to forward and rearward laterally extending sidewalls 24, 25. Along row axis 31, inner covers 17 are spaced apart from one another a first distance, designated as S-1. End covers 17*a*, 17*d* on row axis 31 which are adjacent to end walls 27, 26, respectively, are laterally spaced from end walls 27, 26 a second distance designated as S-2. The distance S-2 is not less than the minimum laterally spaced distance S-1. The individual distances S-1 between adjacent covers 17 can vary with respect to one another and with respect to end distances S-2, but there is a minimum laterally spaced distance which any given S-1 or S-2 distance must exceed. Also, all inner covers 17 are spaced a predetermined distance S-3 from rearward laterally extending sidewall 25 and from forward laterally extending sidewall 24.

Each burner 29 is orientated to fire its products of combustion along a burner axis 33 which is generally perpendicular to laterally extending row axis 31, and extends between or bisects a predetermined space S-1 or S-2. The orientation of burners 29 is dependent upon the orientation of the array of inner covers 17 within heat transfer enclosure 23. It should be apparent from the description thus far that the number of inner covers 17 spaced along row axis 31 equal "n" and that there are "n + 1" laterally spaced distances, namely, "n − 1" laterally spaced distances S-1 and the two laterally spaced end distances S-2. With reference to the arrangement shown in FIGS. 1, 2 and 2A, there are four inner covers 17*a–d* ("n = 4") and there are five ("N + 1") laterally spaced distances S-1, S-2. These laterally spaced distances can be numbered 1 through 5 starting either from the left end wall 27 or the right end wall 26 and burners 29 in the forward laterally extending sidewall would fire (or have axis 33 extending in between) either in between odd numbered laterally spaced distances or in between even numbered laterally spaced distances while the burners in rearward laterally extending sidewall 25 would conversely fire in even numbered laterally spaced distances or odd numbered laterally spaced distances, respectively. With respect to FIGS. 1, 2 and 2A, burners 29*a*, 29*b* and 29*c* are in rearward laterally extending sidewall 25 and would be orientated to fire in odd numbered spaces 1, 3 and 5 while burners 29*d* and 29*e* are positioned in forward laterally extending sidewall 24 and orientated to fire in laterally spaced distances numbered 2 and 4, respectively.

Figure 3:
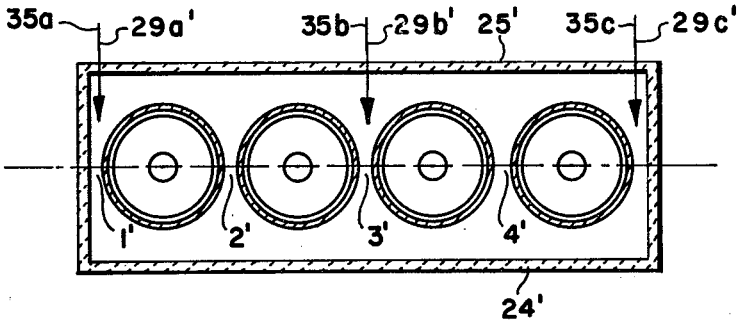
FIG. 3 is a schematic, plan sectional view of a heat treating furnace similar to that shown in FIG. 2.
Figure 3A:
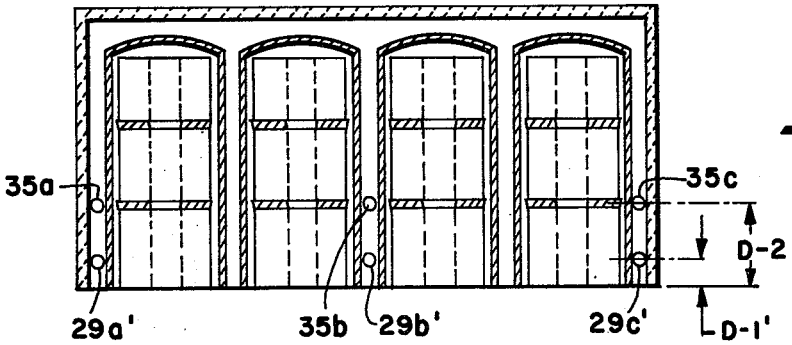
FIG. 3A is a schematic, vertical sectional view of the furnace of FIG. 3.

Referring now to FIGS. 3 and 3A, there is shown a four stand batch annealing furnace similar, except for the burner arrangement, in shape and configuration to that described for FIGS. 1, 2 and 2A and like parts and itmes will be identified by like numbers followed by a prime (') where applicable and will not be described in further detail. In the arrangement shown in FIGS. 3 and 3A, all burners are positioned in rearward laterally extending sidewall 25' and none of the burners are positioned in forward laterally extending sidewall 24'. In particular, burners 29*a'*, 29*b'* and 29*c'*, at elevation D-1' are orientated to fire in spaces 1', 3' and 5', respectively. Additionally, spaced immediately above each of the burners 29' at elevation D-2 is a second row of burners 35*a*, 35*b* and 35*c* orientated to fire perpendicular to row axis 31' at spaces 1', 3' and 5', respectively.

Figure 4:
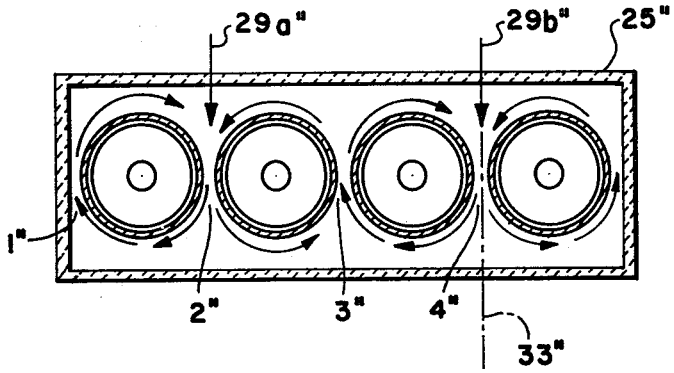
FIG. 4 is a schematic, plan sectional view of a furnace similar to that shown in FIG. 3.
Figure 4A:
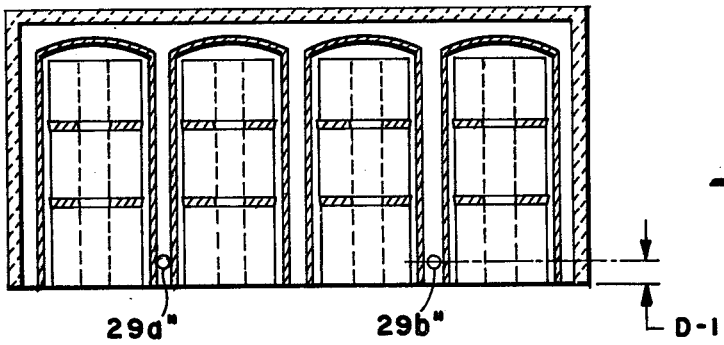
FIG. 4A is a schematic, vertical sectional view of the furnace of FIG. 4.

Referring now to FIGS. 4 and 4A, there is shown a four stand batch annealing furnace similar, except for the burner arrangement, to the furnaces described in FIGS. 1, 2 and 2A, and 3 and 3A, and like parts will be identified by like numbers followed by a double prime (") where applicable and will not be described in further detail. In the arrangement shown in FIGS. 4 and 4A, there are two burners 29*a"* and 29*b"* at elevation distance D-1" in rearward laterally extending sidewall 25" having burner axes 33" generally perpendicular to row axis 31". The burners are orientated so that the burner centerline for burners 29*a"* and 29*b"* bisect even numbered laterally spaced distances 2" and 4", respectively. With the orientation of burners 29, 29' and 29", and inner covers 17, 17', 17" in the arrays defined for each of the three embodiments illustrated, the products of combustion emanating from the burners along with the furnace atmosphere within heat transfer enclosure 23, 23' and 23" will travel about each inner cover 17, 17', 17", and throughout heat transfer enclosure 23, 23', 23" in a serpentine path, which path is illustrated only in FIG. 4 and not in FIGS. 2 and 3 to maintain drawing clarity.

Figure 5:
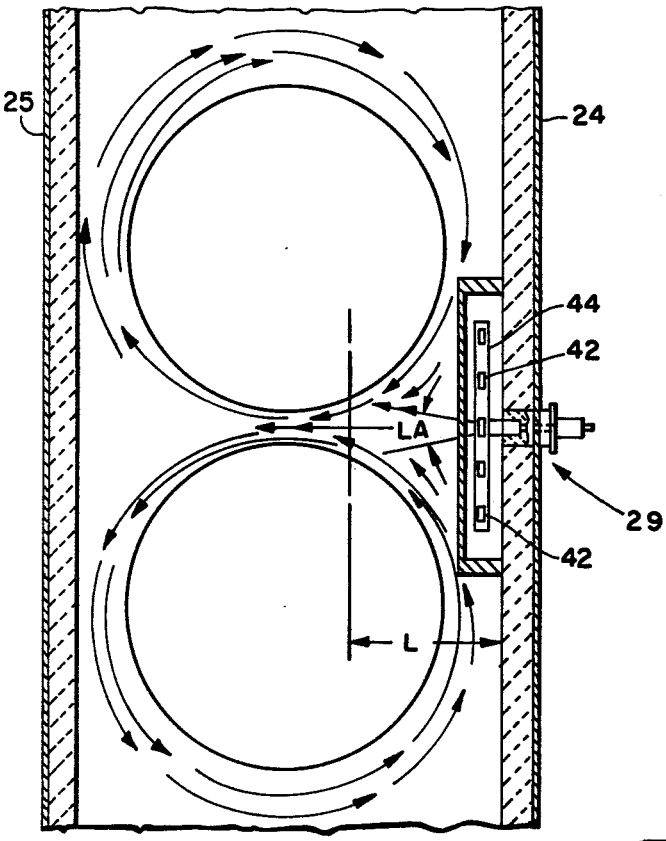
FIG. 5 is a schematic, plan view of a portion of any of the furnaces illustrated showing circulation of the jet gases about the work.
Figure 7:
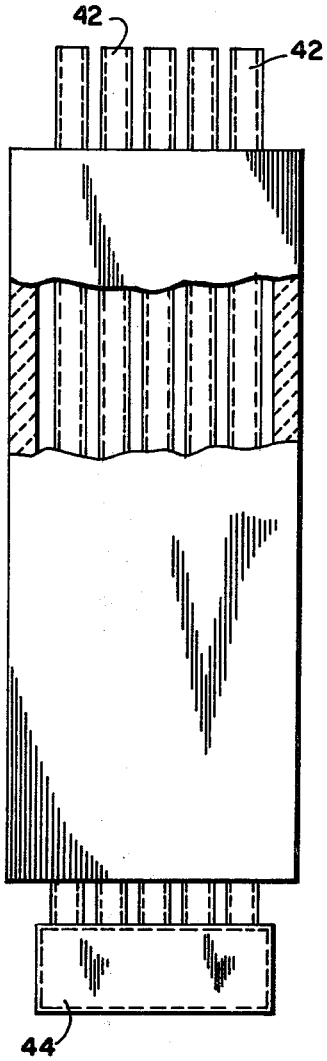
FIG. 7 is an elevational view of the recuperator employed in the present invention.
Figure 6:
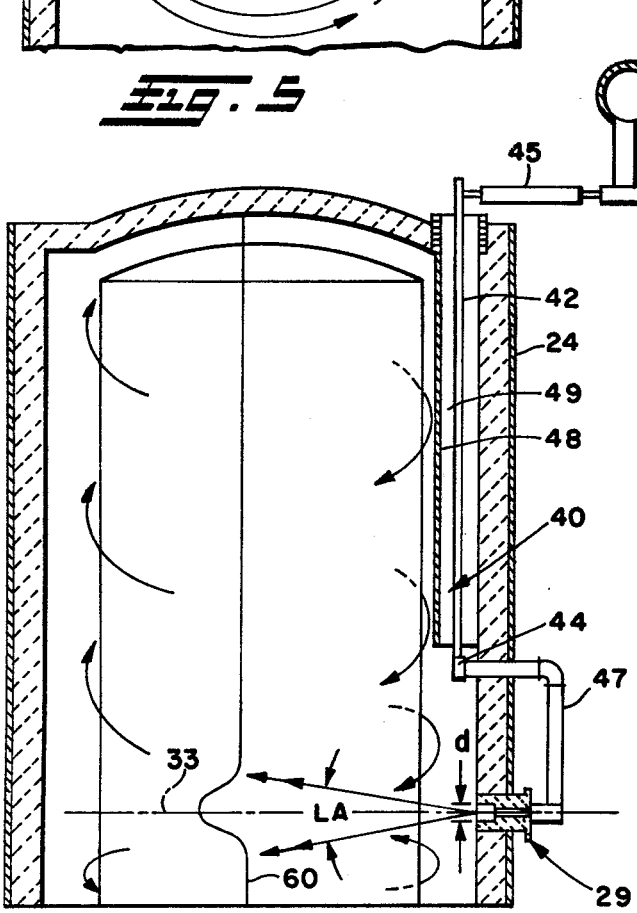
FIG. 6 is a schematic, elevational view of a portion of any of the furnaces illustrated showing the jet flow patterns about the work in a vertical plane.

Referring to FIGS. 5, 6 and 7, there is shown a low profile internal recuperator 40 positioned immediately above any high momentum burner 29. An internal recuperator 40 is positioned above each burner opening in a sidewall 24, 25, although not shown in FIGS. 2, 3 and 4 for drawing clarity. Internal recuperator 40 includes a plurality of laterally spaced, vertically extending heat exchange tubes 42 closely adjacent sidewall 24, 25. Tubes 42 shown in the drawings are flat and oval in configuration although round or other geometric shapes may be employed. The bottom end of each heat exchange tube 42 is connected to a manifold or hot air collector 44 which in turn is connected by appropriate, insulated tubing 47 to burner 29. The top end of each heat exchange tube 42 is connected to an alloy expansion joint 45 and in turn to a common cold air supply header 46. Secured to the interior of sidewall 24, 25 and circumscribing heat exchange tubes 42 is an open-ended radiation shield 48 which defines a flue opening 49 for furnace 10 in which heat exchange tubes 42 are disposed. Radiation shield 48 is shown rectangular in configuration although other low profile shapes may be utilized. The bottom end of radiation shield 48 is spaced slightly above hot air collector 44 and the top end of radiation shield 48 is connected to a conventional-type manifold ducting leading to the stack or flue (not shown). Internal recuperator 40 functions in an ordinary conventional manner, namely, cold air from cold air header 46 is pumped through heat exchange tubes 42 where its temperature is raised through heat exchange contact with upwardly traveling flue gas in flue opening 49 while the air travels downwardly to the burner in heat exchange tubes 42.

The internal recuperator arrangement thus described has several advantages and features which should be noted. First, the efficiency of the recuperator is optimized. As can be clearly seen from FIG. 6, the vertical distance from hot air collector 44 to burner 29 is minimal and since the preheated air travels outside the furnace to burner 29 over this short distance, the drop in temperature of the preheated air is minimal. Second, the position of flue opening 49, in and of itself, represents an optimized location for the flue. That is, radiation shield 48 defining flue opening 49 does not interfere with the flow pattern of the gases through the furnace or with the mixing or entrainment of the products of combustion emanating from the burner with the furnace atmosphere. Also, by locating the opening of flue chamber 49 relatively close to the bottom of the furnace, exhaust of cooler gases from the furnace is insured, since the hotter gases rise by buoyancy to the top of the furnace. Furthermore, the position of the flue opening directly above the outlet of burner 29 prevents any short circuiting of the burner's products of combustion into the flue opening. Conversely stated, only the furnace atmosphere is exhausted through the flue opening. Also, the position of flue opening 49 insures the circulation of the gases about inner cover 17 and insures the serpentine movement of the gases about the furnace as heretofore described with reference to FIG. 4. Third, the low profile of internal recuperator arrangement 40 thus described permits installation of the recuperator arrangement (and likewise the high momentum burner arrangement described) in existing radiant tube and flat flame burner batch annealing furnaces which heretofore utilized external recuperator systems.

Figure 8:
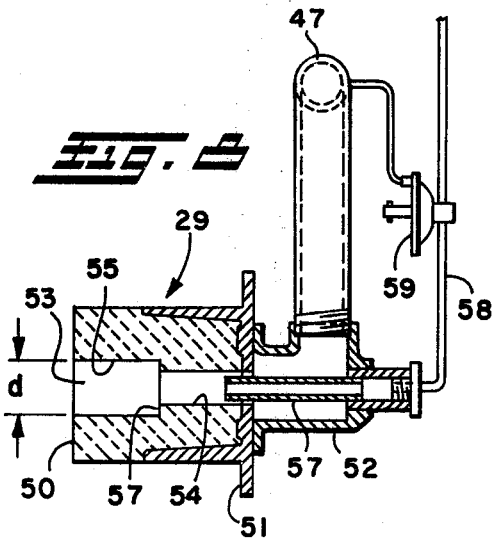
FIG. 8 is a schematic view of a burner suitable for use in the present invention.

In FIG. 8, there is basically shown a high momentum or high velocity burner 29 of a design that may be suitable for use in the present invention. Other high velocity or high momentum burners known in the art may be employed. Burner 29 comprises at one end a hollow, refractory burner block 50 secured to a mounting plate 51 which in turn is secured to a hollow air chamber casting 52 at the other end of burner 29. Within burner block 50 is a stepped cylindrical throat section opening 53 having a smaller diameter section 54 in communication with air chamber casting 52 and a larger diameter section or nozzle 55 opening to the end of burner 29. Extending through air chamber casting 52 and into smaller diameter section 54 is a gas nozzle tube 57 in turn connected to a gas line 58. Threadably engaged to air chamber casting 52 is insulated tubing 47 and regulating the pressure and flow of the air in tubing 47 and gas in line 58 to burner 29 is a pressure regulator 59. In operation of burner 29, air and gas are injected into smaller diameter section 54 and ignited at the step between smaller and larger diameter sections 54, 55 by a spark plug in a conventional manner and the hot gases or products of combustion are discharged from burner 29 through larger diameter section 55. By maintaining the diameter "d" of larger diameter section 55 relatively small, the velocity of the products of combustion can be materially increased at the same gas and air pressures and flows normally employed in conventional burners.

OPERATION

The operation of the batch coil annealing furnace 10 may be best explained by reference to FIGS. 5 and 6. For descriptional purposes only, the products of combustion or hot gases emanating from burner 29 are shown by leaders with double arrowheads and the furnace atmosphere or flue products are shown by leaders with single arrowheads. The products of combustion emanating from burner 29 assume a cone-shaped configuration having an angle of LA, approximately 15°, and conventionally defined as a free-standing circular jet stream. The jet stream of each burner 29 fires between inner covers 17 along its axis 33 and by virtue of its velocity characteristics each jet stream sucks or aspirates or entrains the furnace atmosphere within the stream from the furnace area adjacent sidewall 24, 25 on which the burner is mounted. It should be noted that mixing of the products of combustion and furnace atmosphere is essentially completed by the time both gases reach the area of the furnace adjacent the furnace sidewall 24, on which burner 29 is mounted. The entrainment of the furnace atmosphere is, however, substantially complete before the products of combustion impinge or strike inner covers 17. The opposite sidewall 25 then forces the products of combustion and the entrained flue products (the furnace atmosphere) to take a circulatory path about inner covers 17 (such circulatory movement being enhanced by flue opening 49) and the arrangement of the burners in the array previously described causes a serpentine type movement of the furnace atmosphere about each inner cover throughout the furnace enclosure. In FIG. 6, there is a line 60 which is believed indicative of the velocity profile of the circulating flue products over the length of the inner cover. The profile shows that a maximum velocity occurs at the burner axis 33 and then continually decreases at points vertically spaced at further distances from axis 33. It is believed that the circulatory motion about inner covers 17 in a vertical plane may be analogized to the motion imparted to a cup of liquid when stirred. It should also be noted that while velocity profile 60 indicates a greater velocity occurs at burner axis 33, tests have shown that uniform heating of the cover occurs over the cover length and it is believed that uniformity results because the buoyancy of the gases results in a higher temperature furnace atmosphere at the top of the furnace than at the furnace bottom.

More specifically, it is critical to the operation of the batch coil annealing furnace 10 that inner cover 17 be heated uniformly about its entire periphery and further that such uniform peripheral heating be maintained over the length of the cover. A variation or gradient of 200° F. is considered acceptable for annealing temperatures typically between 1100° F. and 1700° F. to insure maximum cover life at minimal thermal stress. "Hot spots" at any point on the inner covers cannot be tolerated.

That the high momentum burners and burner arrangement disclosed herein can satisfy this function may be demonstrated by consideration of the following formulas:

(1) Convection heat transfer is defined by the following formula:

$$q = hA\Delta T$$

Where q = heat transferred in Btu/hr.
h = heat transfer coefficient in Btu/hr.Ft.$^2$ ° F.
A = area of heat transfer in Ft.$^2$.
ΔT = temperature difference between the solid surface and gas in ° F.

It is obvious from a consideration of Equation 1 that uniform heat transfer can be obtained for all areas of the inner covers if the terms h and ΔT are the same for all areas considered.

(2) As described above, the movement of the products of combustion emanating from high momentum burners 29 entrains the furnace atmosphere which is at a lower temperature and thereby dilutes the temperature of the products of combustion. When the entrainment is high (a high entrainment ratio), a more uniform ΔT (Equation 1) results since the products of combustion contained within the jet stream are diluted in temperature to very near or equal to the temperature of the furnace. (The furnace atmosphere is characteristically near or equal to the control temperature of the furnace.) Thus, the importance of using high momentum burners in the present invention is that such burners have by design high entrainment ratios. High momentum burners result in the burner products of combustion issuing from the burners at very high velocities. Importantly for a given input, the high momentum burner will theretofore have a much smaller burner port size than a lower pressure burner of equivalent heat input. The entrainment ratio of a fluid jet is expressed as:

$$E = K\,L/d$$

Where

E = entrainment ratio expressed as the jet flow at distance L divided by the initial jet flow.
K = constant related to the jet shape.
L = the distance of jet travel (ft.).
d = the characteristic dimension of the initial jet (ft.).

Referring to FIG. 8, the burner port size is defined by "d" and the travel distance of the jet (FIG. 5) is represented by "L". The entrainment ratio and thus the entrainment for a high momentum burner will therefore be significantly higher than lower pressure burners because of the smaller port size used in high momentum burners. An ideal or preferable L/d ratio would be 30, but typical ratios for high momentum burners equal 13 where "d" equals 3".

(3) A second important function resulting from the high velocity jet pump produced by the high momentum burner is that a more uniform heat transfer coefficient, h, (Equation 1) is promoted over the inner cover surfaces. Just as the jet stream temperature is diluted when entrained with the furnace atmosphere, the jet stream velocity is also slowed when the surrounding flue gases are entrained within the jet stream. The velocity of the fluid jet along its axis of travel is expressed as:

$$V_o/V_1 = k\,(d/L)^n$$

Where $V_o$ = initial jet velocity (fpm).
$V_1$ = jet velocity at distance L (fpm).
k = constant related to jet shape.
d = jet diameter (ft.).
L = jet travel distance (ft.).

Thus, the smaller the jet diameter, angle LA, the lower the jet velocity at a given distance and, it should be noted, that the jet diameter is a minimum for high momentum type burners. Given that a rapid velocity decay occurs in a free-standing circular jet stream, then more uniform velocities come into contact with the surfaces of the inner cover. Since the heat transfer coefficient is a function of velocity to the 0.8 power, $h = k\,V^{0.8}$, the transfer of heat to the inner cover is stabilized in this respect.

In brief summary, high entrainment produces rapid velocity decay and a dilution in the temperature of the products of combustion which, combined, promote uniform heat transfer to all surfaces of the inner cover 17.

A number of tests have been conducted on scale mock-up furnaces with burner arrangements as shown in the various embodiments described herein. On all embodiments, the temperature gradients were less than 200° F. in both vertical and circumferential directions. No difference in the vertical temperature gradient was observed for a single burner or level arrangement as opposed to the two burner level arrangements. For both levels, the maximum temperatures occurred at burner levels between the covers. A slight improvement was had on the circumferential gradient level for the single burner level system as compared to the circumferential gradient level which occurred at the two level burner arrangements. Temperature gradients remained very constant during startup of the furnace and did so even during high input, fast heat-up times. The maximum temperature recorded in front of the jet profile was 1580° F. This temperature was only 100° F. above the furnace temperature which was at 1480° F. The maximum velocity of the jet was recorded at 8,250 fpm. No significant disturbance of the sand seal was observed and the presence of any back or eddy currents in the flow pattern was not significantly detrimental to the furnace or furnace operation. The tests also indicated that the refractory of the furnace is to be a high grade type. The tests are believed to definitely show that uniform heating of the inner covers can be accomplished by means of high velocity jet streams orientated in the manner described herein.

The invention has been sized for application to an existing four stand batch coil annealing furnace with the burner arrangement positioned as shown in FIGS. 2 and 2A. Outer cover 21 has interior dimensions of 35'6" for sidewalls 24, 25 and 9' for end walls 26, 27 and an interior height of 15'9¾". Bell shaped covers 17 have an outside diameter of 7'1½" and a height of 15'2". Bell shaped covers 17 are placed within outer cover 21 to have a typically laterally spaced distance S-1 of 16½". Burner axis 33 for burners **29*b*, 29*d* and 29*e* will typically bisect laterally spaced distance S-1 so that a typical distance of 8¼" would exist from axis 33 to any cover 17. The second laterally spaced distance S-2 is typically equal to 17" with the distance from burner axis 33 to annealing cover 17*a* and 17*d* typically set at 6½" and the distance from burner axis 33 to end walls 26, 27 set at 10¾". It is anticipated that the minimum space distance from the center of burner axis 33 to any cover 17 would not be less than 6". The distance D-1** of the burners is 3'8".

The internal recuperator 40 (for each burner) is set to utilize six round tubes 42, approximately 1" inside diameter, set on centers 3½" removed from one another. Tubes 42 are spaced approximately 3" from sidewall 24, 25 and 3" from radiation shield 48. Each tube has a total cold length of approximately 9'7⅛" and the distance from the hot air collector 44 to the burner 29 is approximately 3'3".

It should also be mentioned that the invention has not yet been tested in a multistand batch coil annealing furnace where multiple rows of inner covers 17 are employed and it is not known whether a problem will exist in the circulation of the furnace atmosphere in the space between opposite covers in adjacent rows. If the circulation problem does exist in this area, it may be solved by the location of a flue which will assist circulation of the furnace atmosphere in the desired direction.

The invention has been described with reference to a preferred embodiment. Obviously, modifications and alterations will occur to others skilled in the art upon the reading and understanding of the specification. It is our intention to include all such modifications and alterations insofar as they come within the scope of the present invention.

It is thus the essence of the invention to provide an efficient heat transfer arrangement in a furnace employing a plurality of work items arranged in an ordered array whereby high velocity jet streams are arranged in a manner to effect a substantially uniform heat transfer relationship for each of the work items.

Having thus disclosed the subject invention, we claim:

1. A furnace for effecting heat transfer with injected gases and having a plurality of "n" work items comprising:

a base;

an outer furnace cover having a pair of generally parallel sidewalls, including one sidewall and an opposite sidewall, a pair of generally parallel end walls and a roof, said outer cover sealingly secured to said base to define a heat transfer enclosure;

said work items being arranged on said base in a row along an axis generally parallel to said sidewalls, each work item spaced laterally apart from one another a lateral distance with each end item in said row spaced laterally away from an associated end wall a lateral distance, said laterally spaced distances totalling n + 1 spaces and numbered consecutively from either end wall; and jet pump means effecting heat transfer in a substantially uniform manner with all surfaces of each work item, said jet pump means including a plurality of high momentum jet nozzles adapted to discharge gases at high velocity in one of said sidewalls, each nozzle aligned along a jet axis generally perpendicular to said row axis and approximately bisecting an associated lateral distance, said nozzles adapted to fire their gases in alternate lateral spaces.

2. The furnace of claim 1 further comprising:

jet pump means effecting heat transfer in a substantially uniform manner with all surfaces of each work item, said jet pump means including a plurality of high momentum jet nozzles adapted to discharge gases at high velocity, each nozzle aligned along a jet axis generally perpendicular to said row axis and approximately directing an associated lateral distance, said nozzles in the one sidewall adapted to fire their gases in even numbered lateral spaces and said nozzles in the opposite sidewall adapted to fire its gases in odd numbered lateral spaces.

3. The furnace of claim 2 wherein:

said work items include a plurality of metal coils placed one on top of the other to define a stack, a plurality of "n" stacks, an inner cover disposed over each stack and sealingly secured to said base to define a heat treating enclosure for treating said coils; and said jet pump means defined as high momentum burners, each burner having a throat section for carrying fuel and combustion, said throat section terminating in a larger diameter section of predetermined size opening to said heat transfer enclosure, said larger diameter section being said nozzle.

4. The furnace of claim 3 further including:

a radiation shield extending along the interior of one of said sidewalls from said roof to a predetermined distance from said jet axis of one of said burners, said shield and said sidewall forming a flue opening for said furnace;

a plurality of air tubes within said flue opening, each air tube having an upper end in fluid communication with a cold air supply header and a lower end in fluid communication with a hot air collector and tubing extending through said sidewall to said one of said burners from said hot air collector to supply preheated air from said air tubes to said one of said burners.

5. The furnace of claim 4 wherein each burner has a separate radiation shield associated therewith.

6. In a multistand batch coil annealing furnace having a base, a plurality of "n" inner covers, each inner cover enclosing work and sealingly secured to said base, an outer cover having a pair of generally parallel sidewalls, end walls, and a roof sealingly secured to said base to define a heat transfer enclosure containing said inner covers, said inner covers arranged in spaced increments in a row along an axis generally parallel to said sidewalls and spaced laterally apart from one another and from said end walls a total of "n + 1" spaces numbered consecutively from either end wall, the improvement comprising:

jet pump means issuing high velocity hot gases in said heat transfer enclosure for substantially entraining therewith the furnace atmosphere prior to wiping said inner covers, said jet pump means including a plurality of high momentum burners;

each burner orientated to fire its hot gases along an axis generally perpendicular to said row and in an associated space, said high momentum burners disposed in at least one of said sidewalls and further orientated to fire their hot gases in either all odd or all even numbered spaces to effect a circulatory motion of said hot gases in said furnace about each inner cover which is opposite in rotation to that established about an immediately adjacent inner cover.

7. The furnace of claim 6 wherein a first plurality of high momentum burners are disposed in one sidewall and orientated to fire in odd numbered spaces and a second plurality of high momentum burners are disposed in the opposite sidewall and orientated to fire in even numbered spaces.

8. The furnace of claim 7 further including:

a radiation shield extending along the interior of one of said sidewalls from said roof to a predetermined distance from said burner axis of one of said burners, said shield and said sidewall forming a flue opening for said furnace;

a plurality of air tubes within said flue opening, each air tube having an upper end in fluid communication with a cold air supply header and a lower end in fluid communication with a hot air collector and tubing extending through said sidewall to said one of said burners from said hot air collector to supply preheated air from said air tubes to said one of said burners.

9. A method for batch furnace annealing a plurality of "n" work items positioned on a base and spaced apart from one another in a row to define a plurality of n + 1 spaces and covered by an outer cover defining a heat treating enclosure, said method comprising the steps of:

(1) injecting through a jet pump means in said cover into said enclosure at least first and second conical jet streams of hot gases, each stream being along an axis perpendicular to said row and in a separate space;

(2) controlling the velocity of said hot gases to substantially entrain the furnace atmosphere within the hot gases while lowering the temperature of said hot gases when entrained with said furnace atmosphere to the furnace control temperature prior to wiping said work items with said streams; and (3) directing the jet streams in a particular sidewall of the outer cover into alternate spaces between work items, thereby swirling the entrained hot gases and furnace atmosphere about each work item in a circulatory direction which is opposite to the swirl about an immediately adjacent work item.

* * * * *